US005314098A

United States Patent [19]

Milenkevich

[11] Patent Number: 5,314,098

[45] Date of Patent: May 24, 1994

[54] AUTOMATIC DOSING DISPENSER EMPLOYING ATMOSPHERIC VENT TO IMPROVE OPENING RELIABILITY

[75] Inventor: Joseph A. Milenkevich, Cincinnati, Ohio

[73] Assignee: The Procter & Gamble Company, Cincinnati, Ohio

[21] Appl. No.: 82,686

[22] Filed: Jun. 24, 1993

[51] Int. Cl.[5] ..... B67D 5/64

[52] U.S. Cl. ..... 222/463; 68/17 R; 222/481; 222/500

[58] Field of Search ..... 222/463, 500, 481, 481.5, 222/543; 68/17 A, 17 R, 207

[56] References Cited

U.S. PATENT DOCUMENTS

| | | | |
|---|---|---|---|
| T993,001 | 4/1980 | McCarthy | 68/17 R |
| 2,956,709 | 10/1960 | Nison et al. | 222/52 |
| 2,970,463 | 2/1961 | Johnston | 68/17 A |
| 3,108,722 | 10/1963 | Torongo, Jr. et al. | 222/463 |
| 3,316,741 | 5/1967 | Harlow et al. | 68/207 |
| 3,620,054 | 11/1971 | Drews et al. | 68/17 A |
| 3,699,785 | 10/1972 | Waugh | 68/17 A |
| 3,888,391 | 6/1975 | Merz | 222/52 |
| 4,656,844 | 4/1987 | Mulder et al. | 68/17 A |
| 5,033,643 | 7/1991 | Schumacher | 222/52 |
| 5,040,311 | 8/1991 | Roy | 34/60 |

FOREIGN PATENT DOCUMENTS

| | | |
|---|---|---|
| 602945 | 4/1926 | France . |
| WO89/07678 | 8/1989 | World Int. Prop. O. . |

*Primary Examiner*—Kevin P. Shaver

*Attorney, Agent, or Firm*—Dean L. Garner; E. Kelly Linman

[57] ABSTRACT

An improved dispenser for reliably adding fluid rinse additive to the rinse water in an automatic washing machine. The dispenser includes a filling/dispensing aperture within the uppermost portion of a container for adding the fluid additive to the dispenser and for allowing the rinse water to enter and exit the dispenser. The dispenser is provided with a manually closable centrifugally openable valve for closing the filling/dispensing aperture in the container after it has been filled with additive. The valve maintains substantially all of the fluid additive within the dispenser throughout the wash cycle until the dispenser is opened by the centrifugal force during the spin empty portion of the wash cycle. The dispenser further includes a vent which is operatably associated with the valve to vent the interior of the container to the atmosphere whenever the valve is in its closed position. The vent is positioned within the container so that it cannot be submerged in a fluid additive regardless of the orientation of the container so long as the valve remains in its closed position.

9 Claims, 3 Drawing Sheets

AUTOMATIC DOSING DISPENSER EMPLOYING ATMOSPHERIC VENT TO IMPROVE OPENING RELIABILITY

TECHNICAL FIELD

The present invention relates to an improved apparatus for dispensing a rinse water additive into an automatic washing machine.

The present invention further relates to such an apparatus which is especially suited to highly concentrated rinse water additives which are added in relatively small volumes, thereby making avoidance of leakage during the wash cycle critical to obtaining the desired benefits to be provided by the additive during the rinse cycle.

The present invention is further related to such an apparatus having an effective seal at the point where its closure member joins the body of the dosing dispenser.

The present invention has still further relation to such an automatic dosing dispenser wherein a vent to the atmosphere is provided to prevent the formation of either pressure or vacuum within the dispenser when the dispenser is subjected to hot and/or cold washing cycles.

The present invention further relates to such an automatic dosing dispenser employing an atmospheric vent having an internal passageway which is never submerged beneath the surface of the laundry additive contained within the dispenser, regardless of which orientation the automatic dosing dispenser assumes at any point during the washing cycle prior to automatic opening.

BACKGROUND OF THE INVENTION

Dosing dispensers for the addition of laundering and softening materials during the washing and rinsing cycles in an automatic washing machine are well known in the art.

Dispensers for adding materials during the rinse cycle in an automatic washer are generally more complex than those employed for adding materials during the wash cycle due to the fact that the rinse additive dispenser is normally inserted when the wash cycle begins and must survive the entire wash cycle without dispensing the material contained inside, yet reliably open during the spin cycle at the conclusion of the wash cycle to deliver the rinse water additive at a point in time which will be effective.

One early prior art example of a centrifugal dispenser for delivering materials such as softeners and bleaches is disclosed in U.S. Pat. No. 2,956,709 issued to Nison et al. on Oct. 18, 1960.

Another prior art example of a centrifugal dispenser which is specifically intended to introduce a rinse water additive is disclosed in commonly assigned U.S. Pat. No. 3,888,391 issued to Merz on Jun. 10, 1975 and hereby incorporated herein by reference.

Still another example of such a prior art rinse water additive dispenser is disclosed in U.S. Defensive Publication No. T993,001 to McCarthy, which was published on Apr. 1, 1980, and which is hereby incorporated herein by reference.

Dispensers of the type disclosed in the Merz Patent and the McCarthy Defensive Publication employ a valve means which is automatically opened by centrifugal force acting upon a counterweight during the spin cycle at the conclusion of the wash operation. After the spin cycle, dispensers of this type fall from the wall of the washing machine drum and rinse water floods the dispenser, mixing with and dispensing the additive into the rinse water.

While dispensers of the aforementioned type have functioned adequately for their intended purpose with prior art rinse water additives, recent trends in the development of more effective rinse water additives have been in the direction of more highly concentrated products which deliver comparable performance benefits to the less concentrated products which they are intending to replace. For example, one fluid ounce of a highly concentrated fabric softener, such as Ultra Downy® now being marketed by The Procter & Gamble Company of Cincinnati, Ohio, can deliver benefits comparable to three fluid ounces of a less concentrated fluid softener product of the type which has been on the market for several years.

However, to obtain maximum performance benefits from the newer more highly concentrated products, it has become much more critical that substantially all of the additive material initially placed in the dispenser be retained within the dispenser during the wash cycle, since any lost additive material will not be available to accomplish its intended objective during the rinse cycle.

It has been observed that prior art dispensers of the type described earlier herein may tend to lose some of the additive initially placed in the dispenser during the wash cycle due to flexing of the valve member during the wash cycle, even though the valve may remain in a substantially closed position until the dispenser is subjected to a spin cycle. This premature loss of product due to leakage negatively impacts the benefits provided by highly concentrated rinse additives, since this loss of additive material during the wash cycle renders it unavailable to impart benefits to the laundered fabrics during the rinse cycle. Loss of a highly concentrated additive is particularly detrimental, since it results in a greater loss of the active materials when compared to less concentrated fluid product forms of the prior art.

An automatic dosing dispenser of the type disclosed in copending, commonly assigned U.S. patent application Ser. No. 07/851,581, filed on Mar. 16, 1992 in the names of Richard M. Baginski, Jerome P. Cappell and Gary E. McKibben, the disclosure of which is hereby incorporated herein by reference, discloses a substantially improved valve means employing a movable piston type seal which maintains a more effective seal between the interior of the dispenser and the atmosphere until such time as the dispenser is opened by the centrifugal forces acting upon the counterweight during the spin cycle of the washing machine.

While the improved valve design of Baginski et al. has proven effective in helping to establish a seal which resists premature loss of the liquid laundry additive prior to automatic opening of the valve during the spin cycle, it has unexpectedly been discovered that maintaining such a seal throughout the wash cycle can introduce problems which were not presented when prior art automatic dosing dispenser valves which tended to leak, and consequently which failed to establish an effective seal to the atmosphere, are employed. Specifically, it has been observed that when an automatic dosing dispenser having a valve of the type disclosed by Baginski et al, which establishes an effective seal to the atmosphere, is immersed in a hot wash a pressure buildup occurs within the dispenser. In the case of a hot water wash, the internal pressure acts against the opening motion of the valve during the spin cycle, thereby tending to prevent the valve on the automatic dosing dispenser from reliably opening during the spin cycle. Because the automatic dosing dispenser has two opportunities to open during most complete washing machine cycles, this unreliability may result in the dispenser failing to open during either spin cycle or, even more undesirably, it may open during the second spin cycle used to remove the rinse water from the washing machine. At this point the additive will be of no value. What's more, it may cause staining or discoloration of the fully laundered articles.

Conversely, if a vacuum is formed inside the dispenser during a cold water wash cycle, the pressure imbalance created with respect to the atmosphere tends to cause premature opening of the valve, perhaps losing all of the laundry additive during the wash cycle and rendering it totally unavailable during the desirable portion of the rinse cycle.

OBJECTS OF THE INVENTION

Accordingly, it is an object of the present invention to provide an automatic dosing dispenser which prevents leakage of the liquid laundry additive prior to automatic opening of the valve, but which is not subject to internal pressure build-up or vacuum, regardless of the temperature of the wash water.

It is another object of the present invention to provide such an automatic dosing dispenser which is vented to the atmosphere prior to automatic opening of the valve on said dispenser.

It is still another object of the present invention to provide such a vented automatic dosing dispenser wherein the vent is not submerged in the liquid laundry additive at any time prior to automatic opening of the valve.

SUMMARY OF THE INVENTION

In accordance with the present invention there is provided an improved dispenser that permits reliably adding a predetermined quantity of fluid rinse additive to the rinse water in an automatic washing machine. The dispenser includes a container having an internal volume which is significantly greater than the volume of the fluid additive to be dispensed and which provides buoyancy to prevent the dispenser from becoming entangled within the articles being laundered.

The dispenser further includes a filling/dispensing aperture within the uppermost portion of the container for adding the fluid additive to the dispenser and for allowing the rinse water to enter and exit the dispenser. The dispenser is provided with a manually closable centrifugally openable valve for closing the filling/dispensing aperture in the container after it has been filled with additive. The valve maintains substantially all of the fluid additive within the dispenser throughout the wash cycle and until the dispenser is subject to a predetermined centrifugal force during the spin empty portion of the wash cycle. This predetermined centrifugal force is sufficient to cause the valve to open so that the additive will be retained in the dispenser until it is flushed out by rinse water during the rinse portion of the laundry cycle.

Lastly the dispenser includes a vent which is operatably associated with the valve to vent the interior of the container to the atmosphere whenever the valve is in its closed position. The vent is positioned within the container so that it cannot be submerged in a fluid additive regardless of the orientation of the container so long as the valve remains in its closed position.

BRIEF DESCRIPTION OF THE DRAWINGS

While the specification concludes with claims particularly pointing out and distinctly claiming the present invention, it is believed the present invention will be better understood from the following description taken in conjunction with the accompanying drawings in which:

DETAILED DESCRIPTION OF THE INVENTION

The Body

Figure 1:
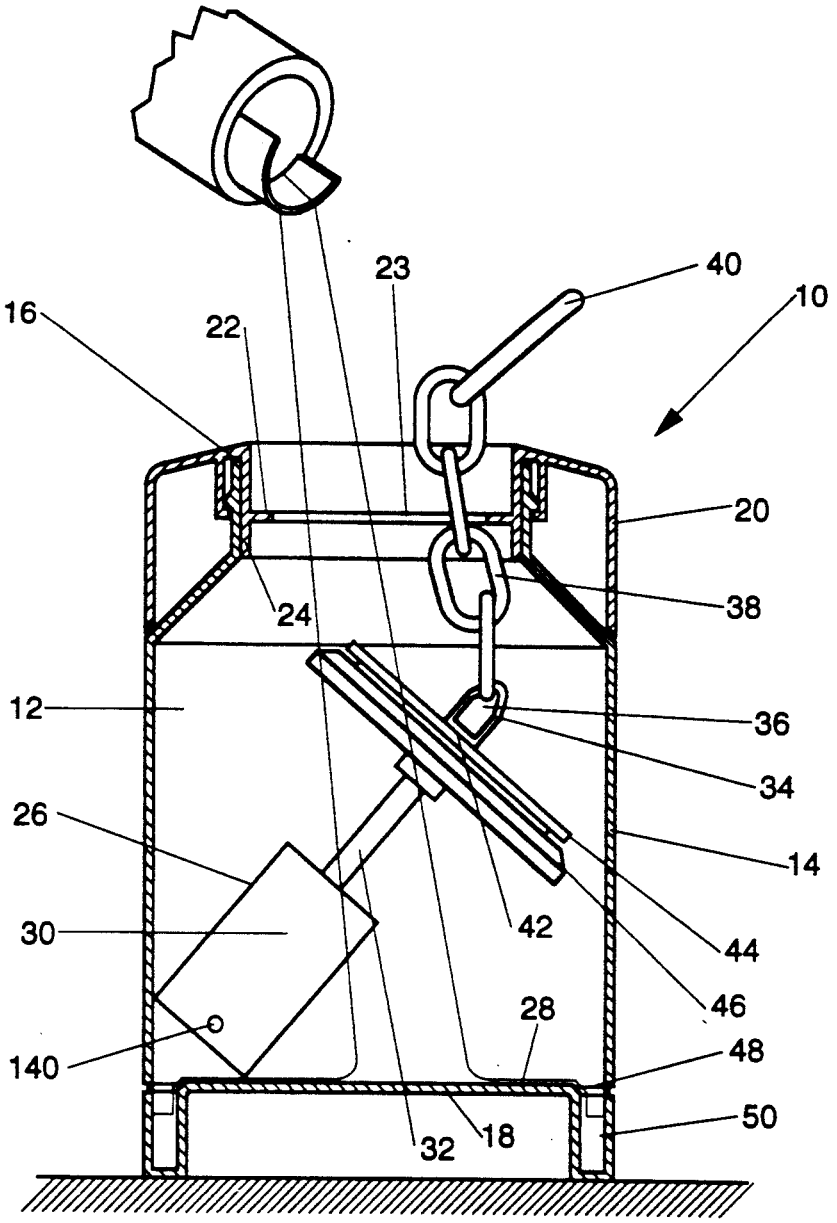
FIG. 1 is a simplified sectioned front elevation view of a dosing dispenser of the present invention, taken through the center of the dispenser, showing the dispenser setting upright with valve open and fluid being poured into the annular volume around the pushup.

Referring now to the Drawings, and more particularly to FIG. 1, there is shown a preferred embodiment of the present invention, generally indicated as 10. While many different shapes including spheres, barrels, cylinders, etc., are possible for the dispenser, a generally barrel shaped embodiment is illustrated in FIG. 1. A fluid dispenser chamber 12 is constructed with continuous side walls 14, with open finish 16 and closed bottom end 18. It is preferable that side walls 14 be made from a flexible material such as a thermoplastic elastomer like santoprene. Snapped onto finish 16 is valve housing 20. Valve housing 20 has an annular flange or face 22 surrounding filling/dispensing opening 23. Annular flange or face 22 serves as a detent which holds the valve member in its closed position. Valve housing 20 also has an internally extending cylindrical wall 24, the internal surface of which forms a seal with the resiliently deformable periphery of a flange 46 on the valve member 42.

The Weight and Pull Ring

Figure 2:
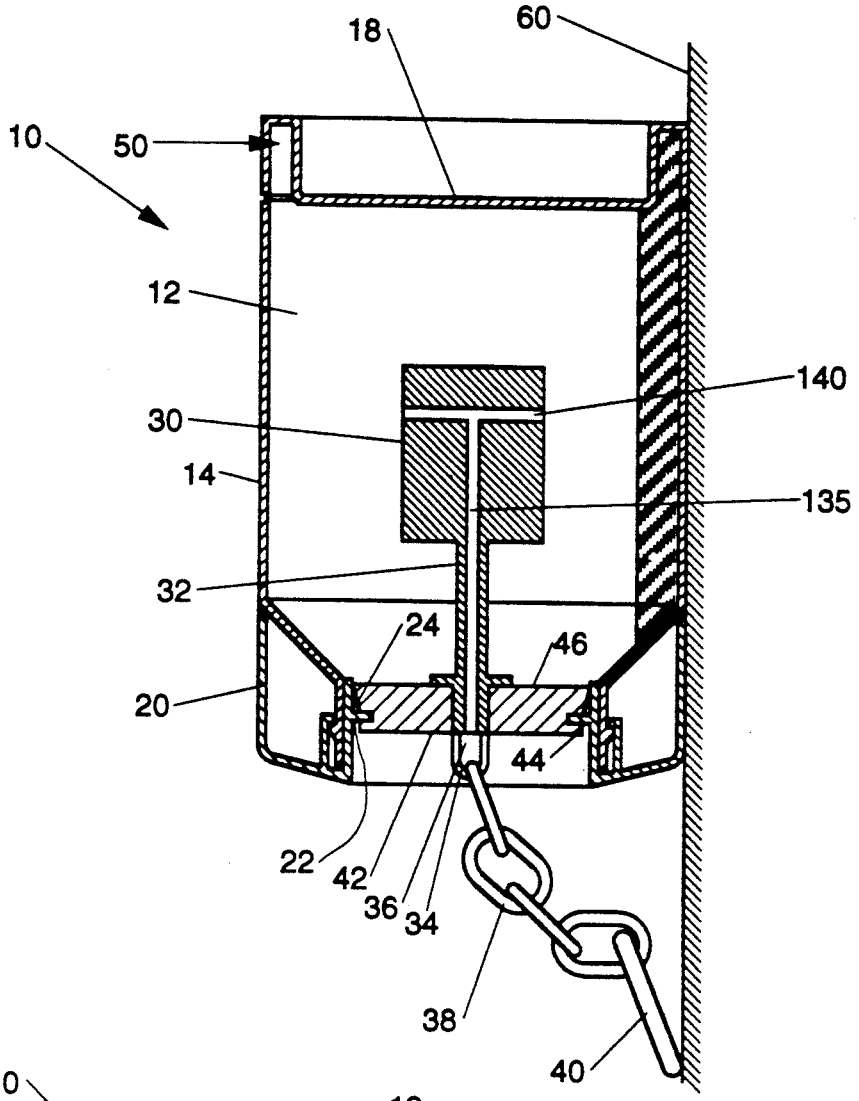
FIG. 2 is a simplified sectioned front elevation view of the same dosing dispenser, taken through the center of the dispenser and through a vertical section of the washing machine drum, showing the dispenser held against the spinning washer drum just before centrifugal force pulls the cantilevered weight toward the drum to open the valve.

In FIG. 1 a valve and weight assembly 26 is shown unseated within chamber 12, resting against inside surface 28 of pushed up bottom end 18. Assembly 26 has a preferably rigid weight 30 and rigid stem 32. As can be seen in FIG. 2, an atmospheric vent comprising a central passageway 135 in stem 32 which interconnects with one or more horizontal passageways 140 in counterweight 30 is also provided. These passageways are preferably of a large enough size to prevent easy clogging, typically 0.060–0.090 inches in diameter. As can best be seen in FIG. 2, the position of horizontal passageway 140 in counterweight 32 prevents the vent from being submerged beneath the surface of the liquid laundry additive regardless of the orientation of the dispenser so long as the valve remains closed. Thus there is no tendency for the liquid laundry additive to prematurely leak out of the dispenser at any time prior to automatic opening of the valve during the spin cycle. At the end of stem 32, opposite weight 30, is a tapered portion 34 with hole 36 therethrough. Connected to tapered portion 34 through hole 36 is a chain 38. Connected to the other end of chain 38 is pull ring 40. Pull ring 40 is used to manually seat assembly 26 after chamber 12 is filled to the desired level with product fluid.

Because the chain and pull ring are flexibly connected to one another, they cannot impart opening forces against the valve member during the wash cycle. They can exert forces only in tension. Furthermore, because the valve member, including tapered portion 34, are recessed completely within valve housing 20, they are substantially protected against premature opening during the wash cycle due to contact with articles of clothing being laundered or portions of the washing machine.

Protection against premature opening is extremely important for rinse additive dispensers, since premature opening of the dispenser during the wash cycle will most likely result in complete loss of the additive during the wash cycle, especially since the dispenser may float with its valve end downwardly oriented.

The Valve Means

Between tapered portion 34 and weight 30 is resilient disk valve 42 connected to stem 32 by means of a groove formed in conjunction with stem 32 which engages a hole in disk 42, preferably by means of an interference fit. As seen from FIG. 1, disk valve 42 has an upper flanged portion 44 which seats against the uppermost surface of annular face 22 and a lower flanged portion 46 which seats against the lowermost surface of annular face 22 when the valve is manually pulled closed. Flanged portions 44 and 46 serve as a detent with annular flange 22 to hold the valve in a closed position until the spin cycle of the washing machine takes place. The portion of valve 42 between flange 44 and flange 46 closes, but does not completely fill opening 23. It also serves to pull flange 44 against face 22 of housing 20 after the resiliently deformable periphery of flange 46 has formed a movable piston-type seal against the innermost surface of cylindrical wall 24. The movable piston-type seal thus formed prevents fluid from exiting chamber 12 despite movement of the flange 46 within cylindrical wall 24 until such time as the detent formed between flanges 44 and 46 and annular flange 22 becomes disengaged from the filling/dispensing aperture 23.

The Valve and Counterweight Assembly

Figure 4:
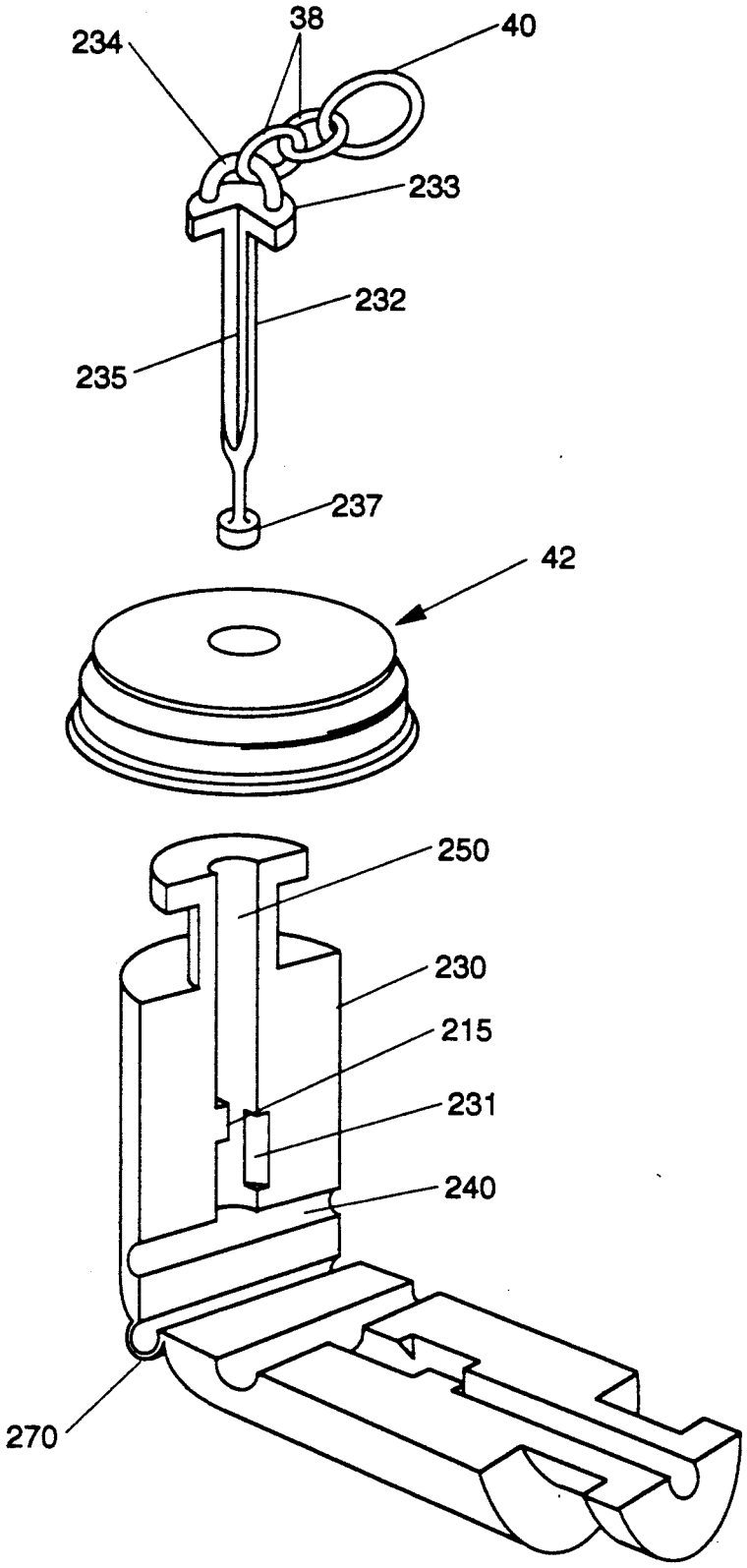
FIG. 4 is a simplified exploded perspective view of a particularly preferred valve and counterweight assembly of the present invention.

In FIG. 4 there is shown a particularly preferred embodiment of a valve and counterweight assembly of the present invention. In the embodiment illustrated in FIG. 4, the counterweight 230 is molded in two segments with the internal passageways 240 and 250, as generally shown, and thereafter folded together about hinge 270 and secured to one another by any suitable means, such as snap fit interlocking pieces, adhesives or the like, after a grooved bayonet-like member 232 and the resilient valve 42 have been assembled and the lowermost end 237 of the bayonet member 232 is inserted therebetween. The projection at the lowermost end 237 of the bayonet-like member 232 serves to retain the bayonet-like member below tab 215 in the counterweight 230, while the groove 235 comprising approximately a quarter of the cross-section of the bayonet-like member serves as a vent channel which connects with the lowermost horizontal vent channel 240 in the counterweight via offset passageway 231.

Filling the Dispenser

When assembly 26 is in the open position, as shown in FIG. 1, and the dispenser 10 is setting upright, either on a horizontal surface or held in one's hand, a product fluid may be poured into dispenser 10 through opening 23. This fluid is preferably highly concentrated in the present invention; therefore, its volume is quite small. However, since it is concentrated, its accuracy of filling to a desired volume is more important than if it were dilute. Dispenser 10 is of a size that is small enough to fit within the washer drum of most clothes washers without being battered by frequent contact with the washer agitator during the wash cycle or interfere with the operation of the washing machine, yet it is preferably large enough that it does not easily become entrapped in clothing, e.g., pockets, pantlegs, etc. Thus, it is preferable that dispenser 10 not be substantially reduced in size relative to prior art dispensers even though a much smaller volume of fluid is normally used in it. This helps to provide the buoyancy needed to keep it near the surface of the water during the wash cycle.

With bottom end 18 pushed up to a point where its inner surface 28 is at or above a fill-line 48 to produce a narrow annular column 50 between side wall 14 and the pushup wall, the ratio of fill height to volume is substantially increased. This higher ratio permits accurate visual alignment of a fluid level with fill-line 48, and therefore accurate filling.

Because the bottom end 18 is pushed up with its inner surface 28 at or above fill-line 48, the annular column 50 thus formed substantially prevents the weight and valve assembly 26 from resting in the additive fluid during the measurement process. Importantly, this avoids displacing fluid which could cause an erroneous volume measurement. What's more, it prevents the atmospheric vent openings in horizontal passageway 140 in the bottom of counterweight 32 from becoming submerged beneath the surface of the liquid laundry additive in the dispenser so long as the valve remains in a closed condition. The proximity of flat surface 28 at or near the level of fill-line 48 also helps the user judge whether or not the dispenser is being held level while filling it.

Need for Buoyancy

After filling and closing the valve 42, dispenser 10 is gently placed in the washer prior to starting the wash cycle. When the wash water rises, dispenser 10 floats in the wash water. Venting of the interior of the dispenser to the atmosphere prevents a pressure buildup inside the dispenser even if the wash water is hot. It also prevents formation of a vacuum inside the dispenser if the wash water is cold. Thus opening reliability of the valve on automatic dosing dispensers of the present invention remains unaffected by the temperature of the wash water. Buoyancy helps prevent dispenser 10 from becoming entrapped in clothing or being battered by the extended agitator fins of the washer below the water level. Although dispenser 10 employs a flexible chain and pull ring and a completely recessed valve member to minimize the chance of premature opening in the wash cycle, excessive clothing or agitator contact is nonetheless undesirable, since severe collisions tend to cause the dispenser to open prematurely. If this happens, the product fluid is lost with the wash water and is not available for the rinse cycle as desired.

Spin Cycle Orientation

Because the illustrated dispenser 10 is shaped like a barrel and has a length greater than its circular cross-section at its most stable orientation is at rest on side wall 14 rather than on an end. FIG. 2 shows how the dispenser 10 may position itself by resting against the innermost surface of the washer's drum 60 during a spin cycle. Side wall 14 contacts the drum 60 during the spinning cycle which follows the washing cycle. In this orientation the centrifugal force of the spinning drum acting on cantilevered weight 30 generates a bending moment at valve 42. The bending moment required to open the valve 42 is relatively predictable as a function of drum RPM. The heavier the weight 30 is the more reliable the opening process would be. If valve housing 20 were resting against the drum during the spin cycle, the centrifugal force would act to hold the valve 42 closed, i.e., it would tend to cause flange 46 to be pushed outward. If bottom end 18 rested against the drum 60, the centrifugal force would act to pull the weight 30 toward the bottom end 18. This would tend to open the valve 42, but would typically require a higher centrifugal force since there is no bending moment of the type presented by a cantilevered beam, as shown in FIG. 2.

Rinse Cycle Orientation

Figure 3:
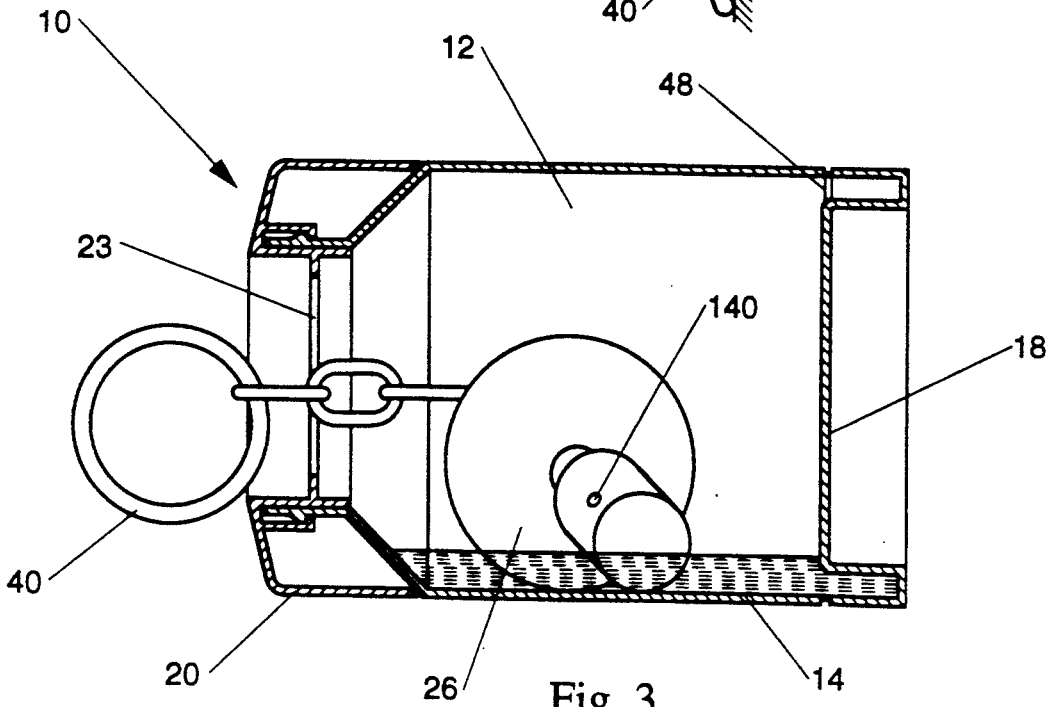
FIG. 3 is a simplified sectioned front elevation view of the same dosing dispenser, taken through the center of the dispenser, showing the dispenser as it would normally lie on the bottom of the drum after the spin cycle with its valve open, just before rinse water enters the dispenser to flood the dispenser and begin flushing out the product fluid.

FIG. 3 shows the dispenser 10 after the washer spin cycle has been completed, the centrifugal force of the spin cycle has opened the valve and the rinse water has begun to enter the drum. When rinse water fills the washer drum, it is desirable for the dispenser 10 become substantially flooded. This flooding process is just about to commence in FIG. 3.

For maximum effectiveness, it is believed most desirable for dispenser 10 to remain close to a substantially horizontal condition so it can fill as much as possible with rinse water and so that turbulence of the rinse cycle agitation can pull it under to help to flush the product fluid out of the dispenser 10.

Pushup used to trim Center of Gravity

The valve and weight assembly 26 fall to one side of chamber 12 when pulled out of opening 23 by centrifugal force in the spin cycle. This effectively moves the center of gravity of the dispenser 10 to near its center. Being longer than it is across, the barrel shaped dispenser 10 then has stability for assuming a natural horizontal orientation and for floating substantially on its side wall 14 during the rinse cycle. To further encourage such orientation or floating, the pushed up bottom end 18 can serve two additional functions. First it can limit the travel of the assembly 26 to maintain the center of gravity of assembly 26 near the center of dispenser 10. Second, it can provide a region to add ballast material in order to trim the center of gravity of the dispenser to an optimum position to ensure complete emptying of the dispenser's contents during the rinse cycle.

Because side wall 14 of the dispenser is normally translucent, and preferably transparent, for easily sighting the fill level of the fluid additive with fill-line 48, varying the thickness of side wall 14 is less desirable because greater thickness typically reduces visibility. However, increasing the thickness of the bottom pushup 18 to provide ballast does not adversely affect the user's ability to visually see the product level during filling. Furthermore, increasing the thickness of the bottom end 18 is less expensive than adding separate weights to the dispenser.

Completion of the Dispensing Cycle

After rinse water has flushed product fluid from the dispenser, and the final machine cycle is completed, the dispenser may be removed from the washer drum and drained of water so that it may be refilled, as in FIG. 1, for the next wash load.

Pull ring connected by chain

FIG. 2 shows the use of a chain 38 to connect the pull ring 40 with the valve and weight assembly 26. In one preferred embodiment the chain comprises only one link in order to help prevent premature opening. An alternative to the chain is a cable or other flexible linkage. These connectors transmit force only when in tension. Therefore, they are not prone to cause premature opening during the wash cycle. Protection against premature opening is maximized when flexible chain 38 and pull ring 40 are used in conjunction with recessing of the tapered end 34 of the rigid stem 32 inward of the outermost surface of housing 20. This protects tapered end 34 of stem 32 from inadvertent bumping during the wash cycle. If desired, the pull ring 40 may be snapped into a detent (not shown) in the valve housing 20 to further protect valve 42 from being prematurely dislodged from opening 23 during the wash cycle.

Exemplary Embodiment

A dispenser embodiment of the present invention can be designed and made as follows:

Dispenser side walls 14 can be approximately 0.03 inches thick and can be made of a material such as clarified polypropylene. They can be shaped generally like a whiskey barrel with a maximum diameter of approximately 3 inches and a maximum height, including valve housing 20, of approximately 3½ inches. Dispenser chamber bottom 18 can be approximately 0.1.5 inches thick and can be pushed up approximately ⅝ inches with a sloping outer diameter ranging from approximately 1.98 inches, as measured at the top of the pushup, to approximately 2.2 inches, as measured at the bottom of the dispenser, thereby creating an annular column 50 below fill-line 48 of approximately 1.8 cubic inches, which corresponds to a volume of approximately one fluid ounce of liquid. Dispenser chamber 12 can be made by a stretch blow mold process of the type well known in the art.

Valve housing 20 preferably has an annular flange 22 measuring approximately 1⅝ inches in diameter and including a filling/dispensing opening 23 which measures approximately 1.1 inches in diameter centered on the axis of the barrel-shaped dispenser. Housing 20 also has an internal cylindrical wall 24 which measures approximately 0.2 inches in length and has an internal diameter of approximately 1.64 inches. Housing 20 can be made of a material such as polypropylene plastic by an injection molding process of the type well known in the art.

Weight 30 and stem 32 may be comprised of a material such as metal, e.g., aluminum, or a substantially rigid plastic, e.g., molded polypropylene. The weight 30, which is preferably molded as two hingedly connected segments in an open condition and thereafter closed about the stem, weighs approximately 0.56 ounces and is positioned so that its center is located approximately 1¼ inches from the center of valve 42, such that the centrifugal acceleration typically experienced in a washing machine spin cycle will dislodge valve 42 from aperture 23 in valve housing 20 during the spin cycle which follows the washing cycle. A vertical vent passageway 135 having a cross-sectional flow area of approximately 0.006 square inches is preferably provided along the axis of stem 32. This vertical vent passageway can intersect a horizontal passageway 140 having a diameter of approximately 0.090 inches, which also provides a cross-sectional flow area of approximately 0.006 square inches, near the bottom of counterweight 30.

Valve 42 can be made of Shore A 58 durometer polyisoprene elastomer by an injection molding process of the type well known in the art. Alternatively, natural rubber can be compression molded to form valve 42. Valve 42 is preferably assembled onto stem 32 by forcing the hole in its center over that portion of the stem to which the weight 30 is secured prior to assembly of the weight 30 onto the stem. Flange 44 on valve 42 can be about 0.035 inches thick and about 1¼ inches in diameter. Flange 46, which also acts as a piston within cylindrical wall 24, can be about 0.07 inches thick. Flange 46 preferably has a minimum outside diameter of about 1 19/32 inches, as measured at its uppermost edge, tapering to a maximum outside diameter of about 1 11/16 inches, as measured at its lowermost edge. In lieu of a taper, a step-like cross-section could be employed to provide the desired degree of resilient deformability at the outermost periphery of flange 46. The tapered portion of flange 46 is resiliently deformable to form a movable piston-type seal with the innermost surface of cylindrical wall 24.

The ring 40, chain 38 and stem 32, including connecting member 34 are preferably molded as one unit using an acetal resin such as Delrin via an injection molding process of the type well known in the art. The pull ring 40 can have an outside diameter of approximately 1.25 inches, an inside diameter of approximately 0.92 inches and is preferably connected to element 34 on stem 32 by means of anywhere from one to three oval links. The first oval link that connects to the pull ring 40 has a major axis of approximately 0.4 inches and a minor axis of approximately 0.23 inches, while the remaining two links have a major axis of approximately 0.34 inches and a minor axis of approximately 0.16 inches.

Dispenser 10 has an overall internal volume of approximately 15.9 cubic inches and a fully assembled weight of approximately 2.33 ounces, not counting the fluid product to be housed within the dispenser. The normal dose of fluid product to be included within the dispenser which is targeted to coincide with fill line 48 is approximately one fluid ounce or approximately 1.8 cubic inches within annular column 50.

While the dispenser 10 is particularly well suited for dispensing relatively small amounts of highly concentrated rinse water additive, it is of course recognized that the dispenser may also be employed to dispense greater volumes of less concentrated rinse water additives. In such applications additional fill level markings can be provided, as appropriate, for less concentrated products. However these fill level lines should be beneath the horizontal passageway portion 140 of the atmospheric vent to avoid submerging the vent in the liquid laundry additive so long as the valve remains closed.

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. An improved dispenser that permits reliably adding a predetermined quantity of fluid rinse additive to the rinse water in an automatic washing machine, said dispenser comprising:

(a) a container having an internal volume significantly greater than the volume of fluid additive to be dispensed to provide buoyancy and to prevent the dispenser becoming entangled within the articles being laundered;

(b) a filling/dispensing aperture disposed within the uppermost portion of said container for adding said fluid additive to said dispenser and for allowing rinse water to enter and exit said dispenser;

(c) a manually closable, centrifugally operable valve means for closing said filling/dispensing aperture in said container after said dispenser has been filled and for maintaining substantially all of said fluid additive within said dispenser throughout the wash cycle until said dispenser is subjected to a predetermined centrifugal force during the spin empty portion of the wash cycle, said predetermined centrifugal force being sufficient to cause said valve means to open, whereby said additive will be retained in said dispenser until it is flushed out by rinse water during the rinse portion of the laundry cycle; and (d) said valve means further including a vent means within said container to vent the interior of said container to the atmosphere whenever said valve means is in its closed position, said vent means being positioned within said container so that it cannot be submerged in said fluid additive regardless of the orientation of said container so long as said valve means remains in its closed position.

2. The dispenser of claim 1, wherein said valve means includes a counter weight which responds to said centrifugal force during said spin cycle and wherein said vent means is at least partially located within said counterweight.

3. The dispenser of claim 2, wherein said container exhibits a generally circular cross-section, as measured perpendicular to its vertical axis.

4. The dispenser of claim 3, wherein said container exhibits a substantially spherical shape.

5. The dispenser of claim 1, wherein said container includes a cylindrical wall surrounding the internal surface of said filling/dispensing aperture and wherein said valve means includes a generally conforming flange having a resiliently deformable peripheral edge which forms a movable piston-type seal against the internal surface of said cylindrical wall when said valve means is in its closed position, said seal being maintained even when there is relative movement between said piston periphery and said internal surface of said cylindrical wall, provided said valve means remains in its closed position.

6. The dispenser of claim 5, wherein said valve means further includes a resilient detent which engages and closes said filling/dispensing aperture in said container when said valve means is in its closed position, yet which will release said valve means to its open position when said counter weight attached to said valve means is acted upon by the centrifugal forces imposed on the dispenser during said spin cycle.

7. The dispenser of claim 6, wherein said manually closable, centrifugally openable valve means is completely recessed from the outermost surface of said dispenser to minimize the chance of premature opening during the wash cycle.

8. The dispenser of claim 7, wherein said manually closable, centrifugally openable valve means includes a flexible tension member which projects beyond the outermost surface of said dispenser for closing said valve, but which tensile member cannot exert inwardly directed opening forces against said valve means during the wash cycle.

9. The dispenser of claim 8, wherein said flexible tension member comprises a chain.

* * * * *

UNITED STATES PATENT AND TRADEMARK OFFICE

CERTIFICATE OF CORRECTION

PATENT NO. : 5,314,098

DATED : May 24, 1994

INVENTOR(S) : Joseph A. Milenkevich

It is certified that error appears in the above-identified patent and that said Letters Patent is hereby corrected as shown below:

Column 8, line 49, "0.1.5" should be -- 0.15 -- .

Column 10, line 30, "operable" should be -- openable -- .

Signed and Sealed this

Twenty-ninth Day of November, 1994

*Attest:*

Bruce Lehman

BRUCE LEHMAN

*Attesting Officer*

*Commissioner of Patents and Trademarks*